US006643490B2

(12) United States Patent
Regimbal

(10) Patent No.: US 6,643,490 B2
(45) Date of Patent: Nov. 4, 2003

(54) SYSTEM FOR PROVIDING VARIABLE FUSING ENERGY TO PRINT MEDIA

(75) Inventor: Laurent A. Regimbal, Round Rock, TX (US)

(73) Assignee: Hewlett-Packard Development Company, LP., Houston, TX (US)

( * ) Notice: Subject to any disclaimer, the term of this patent is extended or adjusted under 35 U.S.C. 154(b) by 26 days.

(21) Appl. No.: 10/012,468

(22) Filed: Dec. 12, 2001

(65) Prior Publication Data

US 2003/0108371 A1 Jun. 12, 2003

(51) Int. Cl.[7] ..... G03G 15/20
(52) U.S. Cl. ..... 399/329; 219/216
(58) Field of Search ..... 399/329, 328, 399/67, 68, 69; 219/216

(56) References Cited

U.S. PATENT DOCUMENTS 5,027,160 A * 6/1991 Okada et al. ..... 399/329
5,164,782 A * 11/1992 Nagayama et al. ..... 399/328
5,196,894 A * 3/1993 Merle et al. ..... 399/328
5,410,394 A * 4/1995 Wayman et al. ..... 399/329
5,887,235 A * 3/1999 Wayman et al. ..... 399/329
5,890,047 A * 3/1999 Moser ..... 399/329
5,918,087 A * 6/1999 Kimura et al. ..... 399/69
5,998,761 A * 12/1999 Berkes et al. ..... 399/67
6,198,902 B1 * 3/2001 Vaughan et al. ..... 399/329

* cited by examiner

*Primary Examiner*—Susan S.Y. Lee

(57) ABSTRACT

A system for varying the amount of thermal energy transmitted to print media in a printing device having a fuser with a pressure roller and a heated drive roller biased against the pressure roller includes a first idler roller, having a location which is variable relative to a print path of print media traveling through the printing device, and a thermally conductive belt, disposed around the drive roller and the first idler roller. Thermal energy transferred to the print media traveling along the print path is varied by changing the location of the first idler roller relative to the print path.

5 Claims, 2 Drawing Sheets

SYSTEM FOR PROVIDING VARIABLE FUSING ENERGY TO PRINT MEDIA

BACKGROUND OF THE INVENTION

1. Field of the Invention

The present invention relates generally to systems for providing fusing energy to print media. More particularly, the present invention relates to a method and apparatus for providing variable fusing energy to print media so as to selectively vary the gloss of the final product without varying the process speed.

2. Related Art

In color printing (i.e. color laser printing and photocopying), fusing plays a large part in determining the level of gloss of the printed output. Transmitting thermal energy to the print media to fuse the toner is an important part of the process. Typical fusing temperatures range from 160° to 190° C., while typical paper media burns at approximately 230° C. Additionally, many of the typical materials used in fusers (e.g. silicone rubber) do not perform well at temperatures above 200° C.

These factors combine to determine the range of acceptable temperatures available for fusing. Generally, a greater amount of thermal energy will produce a higher gloss. However, it is undesirable to scorch or deform the media. Media deformation typically increases with increased fusing temperatures. This is due, many times, to the fact that the peak temperature of fusing can vaporize water contained in the paper. This can produce wave, curl, cockling, and stretch or shrinkage. These types of media deformation are not desirable.

Accordingly, it is desirable to be able to vary the amount of thermal energy which is transmitted to the media to vary the gloss. Conventionally, the most common method used to provide variable fusing energy to printed media is to vary the process speed. By slowing the page down, it has more time to acquire the thermal energy provided by the fuser. However, with this method, the printer throughput, i.e. the rate at which pages may be processed, is decreased as the process speed is decreased. Another method conventionally used to provide variable fusing energy is to change the temperature of the fusing element, typically a heated roller. This latter method can provide increased thermal energy to the print media as well. However, the electrophotographic process does not provide for a large range in which to adjust the temperature, for the reasons mentioned above, and thereby, the amount of thermal energy, fusing (and gloss imparted). The thermal mass of the element typically makes it difficult to change the temperature in a short time period. Moreover, this latter method can tend to deform the media due to excessive temperature levels.

SUMMARY OF THE INVENTION

It has been recognized that it would be advantageous to develop a method of varying the amount of thermal energy transferred to print media which does not decrease the process speed. It has also been recognized that it would be desirable to develop a method of varying the amount of thermal energy transferred to print media which is convenient and reliable. It has also been recognized that it would be desirable to develop a method of varying the amount of thermal energy transferred to print media which allows accurate control, so as to prevent scorching or deformation of the media.

The present invention provides a system for varying the amount of thermal energy transmitted to print media in a printing device having a fuser. The system comprises a heater and a thermally conductive belt, rotatably carried by the printing device, disposed around the drive roller and the first idler roller. The thermal energy transmitted to the print media traveling along the print path is varied by changing the location of the belt by changing the location of the first idler roller relative to the print path.

In accordance with a more detailed aspect of the present invention, the first idler roller is disposed on a pivotable frame, such that the thermally conductive belt may be selectively moved closer to or away from the print media within the fuser.

In accordance with yet another more detailed aspect of the present invention, the first idler roller may be linearly moveable with respect to the drive roller, and a second moveable idler roller may be provided in contact with the belt. When the second idler is moved, the tension on the belt draws the first idler closer to the drive roller, thus reducing the nip width of the fuser.

Additional features and advantages of the invention will be apparent from the detailed description which follows, taken in conjunction with the accompanying drawings, which together illustrate, by way of example, features of the invention.

DETAILED DESCRIPTION

For purposes of promoting an understanding of the principles of the invention, reference will now be made to exemplary embodiments, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are within the scope of the invention.

Figure 1:
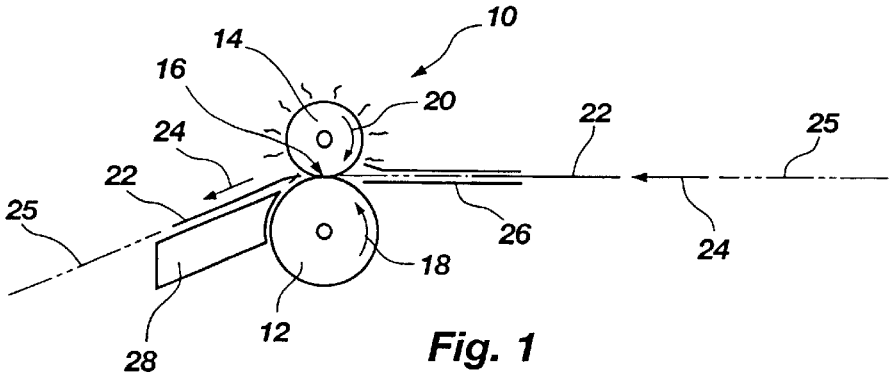
Fig. 1 (PRIOR ART)
FIG. 1 is a side, cross-sectional schematic view of a prior art toner fusing system having a fixed nip width.

Prior art printing systems, as illustrated in FIG. 1, generally include a fuser 10 comprising a pressure roller 12, and a heated drive roller 14. The drive roller and pressure roller are in contact with each other, the area around the point of contact 16 of the two rollers being referred to as the "nip." The drive and pressure rollers counter-rotate in the direction shown by arrows 18. After print toner is applied, print media 22 (i.e a sheet of paper) moves along the print path in a processing direction (represented by arrows 24), from an input or feed alignment device, such as a paper chute 26, into the nip region 16. Additional drive rollers and other devices for printing and moving the paper or other media through the printer are not shown in the drawings, but are well known by those skilled in the art. When print media is brought to the nip area, it is drawn between the drive and pressure rollers, which simultaneously exert heat and pressure upon the paper. This fuses the toner to the page to produce the finished product. The finished print is then ejected to an output chute 28.

Figure 2:
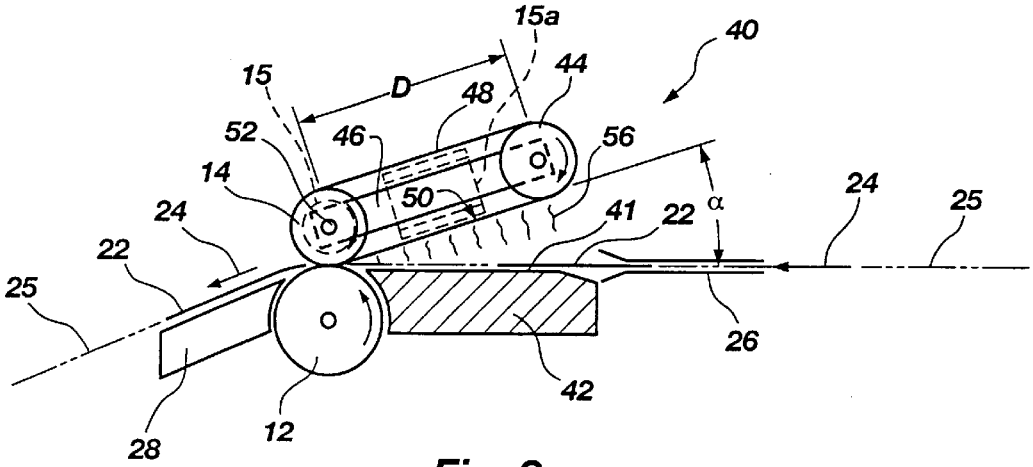
FIG. 2 is a side, cross-sectional schematic view of a variable nip fusing system with the idler roller raised above the guide surface.

In the system of FIG. 1, simple, reliable, and convenient variation of the thermal energy which is applied to each page can be difficult for the reasons set forth above. As mentioned, the processing speed can be reduced, but this is not desirable. Likewise, the temperature of the drive roller 14 can be increased, but this takes time, and can thereby delay printing of the next page. Also, increased heat can lead to scorching or deformation of the print media discussed above. To address these issues, the present invention advantageously provides a fuser system which is configured for providing variable fusing energy to print media without varying the process speed. An exemplary embodiment is shown in FIG. 2. As with the device discussed above, the system 40 can include a heated drive roller 14, including a heater 15, a pressure roller 12, a paper input alignment device 26, and an output chute 28. Disposed between the paper input device and the drive and pressure rollers is a guide 42 formed of a thermal insulating material. The print media 22 travels along a print path 25 through the system in a process direction 24, from the input device, through the nip region 16, and onto the output chute.

Disposed a distance D from the drive roller 14 is a first roller 44. In the embodiment of FIG. 2, the first roller is connected to a frame 46, which holds the first roller a substantially constant distance from the drive roller. A thermally conductive endless belt 48 is disposed around the drive roller and the first roller. The belt is formed of a thermally conductive material, having a high resistance to fatigue failure, such as nickel-plated elastomer. The drive roller 14 and pressure roller 12 are biased against each other, with the belt interposed between them in the nip region 16 where the belt wraps around the drive roller. The first roller and the drive roller, which is the second roller of the two rollers carrying the endless belt, are biased apart to maintain tension on the belt regardless of length changes due to temperature changes. Alternatively, at least, one of the first and the second rollers can be configured to have a compressable/expandable outer surface to maintain tension on the belt. While the heater 15 is conventionally incorporated in a roller 14, it can be located elsewhere. For example, a heater 15*a* can be carried by the frame within the thermally conductive belt, and can be configured to transfer heat to the belt via contact or radiation.

Being wrapped around the second, or drive, roller 14 and the first roller 44, the belt 48 comprises a tangent (i.e. straight) portion 50, which faces a top surface 41 of the guide 42. Advantageously, the frame 46 is configured to rotate about a rotational axis 52 of the drive roller, so as to enable movement of the tangent portion of the belt closer to or farther from the print path/print media adjacent the guide. It will be apparent that when the frame rotates, the idler roller moves along an arcuate path, indicated by arrow 54, and the tangent portion of the belt forms an angle a relative to the adjacent guide print/path, which is planar in this embodiment. Through rotation of the frame, the belt may be moved from one position, shown at 48A in FIG. 3, wherein the tangent portion of the belt is close to and substantially parallel to the print path (and the guide), to the print path, to any one of a variety of positions, such as positions 48B, 48C, and 48D in FIG. 3, that are each relatively closer or farther away from the print path depending on the angular relationship between the frame and the print path.

This configuration effectively allows variation of the amount of thermal energy (indicated by wavy lines 56) transferred to the print media. For example, when the frame 46 and the first roller 44 are positioned so that the belt is parallel to the print path (48A in FIG. 3) the straight, or tangent portion 50 of the belt 48 is closest to the guide, and therefore transfers maximum thermal energy to the print media 22, as the media travels along the print path between the guide and the belt, before passing between the pressure roller 12 and drive roller 14. This effectively increases the nip width, at least in terms of transferring thermal energy, to a dimension approximately equal to the entire distance between points of tangency to the first and second rollers, respectively, indicated as dimension $W_n$ in FIG. 3.

Figure 3:
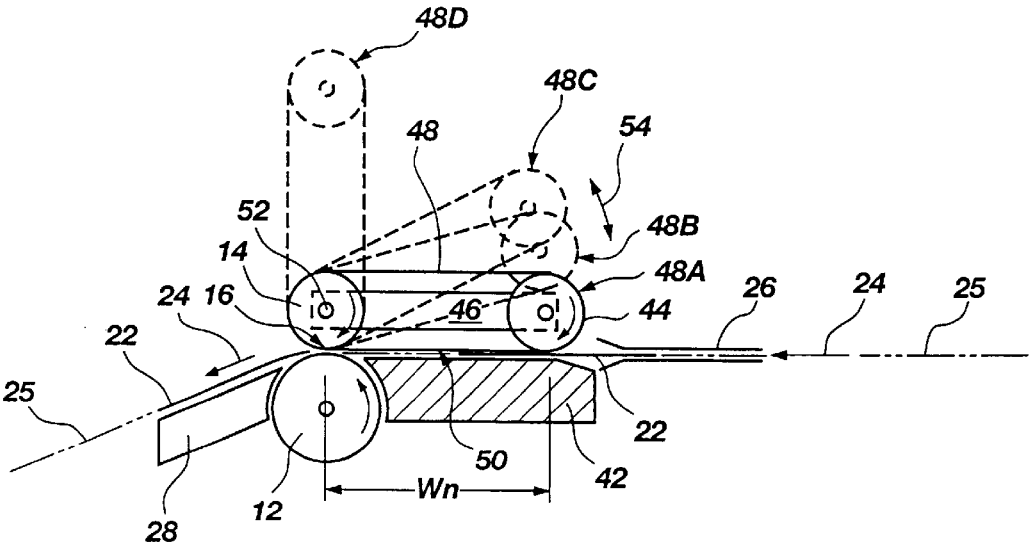
FIG. 3 is a side, cross-sectional schematic view of the variable nip fusing system of FIG. 2, with the idler roller lowered to a position close to the guide surface.

However, when the frame 46 and first roller 44 are rotated up and away from the guide 42, such as to position 48B or 48C in FIG. 3, or as shown in FIG. 2, the intensity of thermal radiation 56 is decreased and the amount which is transferred from the belt 48 to the print media 22 is reduced, simply by virtue of the increase in average distance between the belt and print path. Viewing FIG. 3, the several possible angular positions of the frame/roller/belt assembly shown in dashed lines illustrates that in one embodiment any angular orientation of the frame/idler/belt assembly relative to the guide is possible. In another embodiment a plurality of "stops" (not shown) provides a plurality of discrete possible angular positions for the belt tangent portion 50 with respect to the print path. The smaller the angle, the more energy is transferred, with an angle of 0° (i.e. parallel to the guide) providing the greatest energy transfer. It will be apparent that minimum energy transfer will occur when the angle a is about 90°, as shown at position D in FIG. 3. As a practical matter, because of the rapid decline in energy transfer as a approaches 90°, the position for minimum energy transfer may be selected as some angle a substantially less than 90°. Nevertheless, by rotating the frame/idler/belt assembly toward or away from the guide, the amount of thermal energy transferred to the print media traveling along the print path can be more easily varied without changing the process speed.

Figure 4:
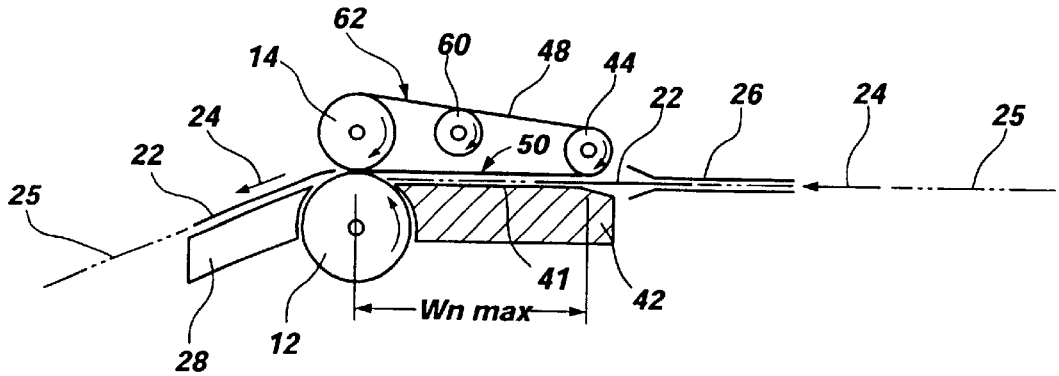
FIG. 4 is a side, cross-sectional schematic view of an alternative variable nip fusing system incorporating a second moveable idler roller disposed on the inside of the endless belt, the second idler roller being lowered so as to maximize the nip width.
Figure 5:
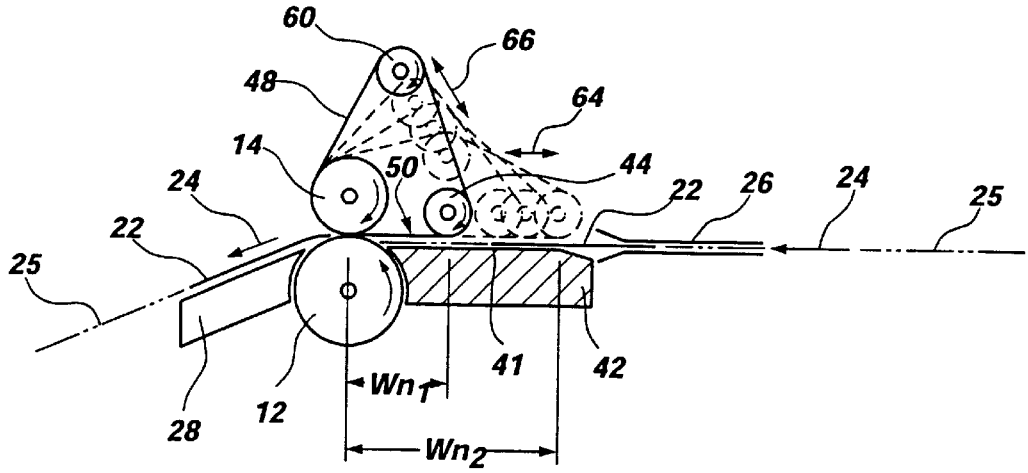
FIG. 5 is a side, cross-sectional schematic view of the variable nip fusing system of FIG. 4, with the second idler roller raised to a position substantially above the drive roller, so as to minimize the nip width.
Figure 6:
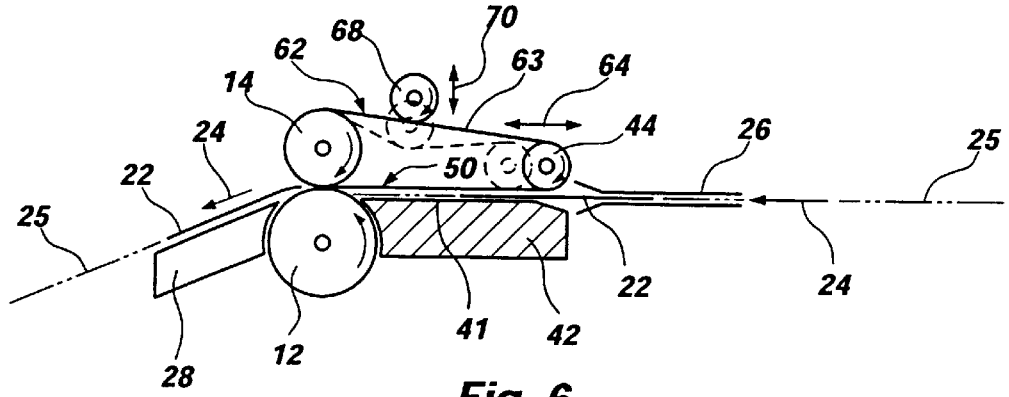
FIG. 6 is a side, cross-sectional schematic view of an alternative variable nip fusing system incorporating a moveable second idler roller disposed on the outside of the endless belt.

Other methods of varying the effective nip width for thermal transfer may also be employed. For example, FIGS. 4–6 depict other possible embodiments of the present invention wherein a third roller, acting as an idler roller is provided. This allows for varying the distance between the drive roller 14 and the first roller 44 while maintaining tension on the belt 48. Viewing FIGS. 4 and 5, an idler roller 60 is disposed between the drive roller 14 and the first roller 44, and abuts the underside of a top portion 62 of the belt 48. The first roller is moveable in a direction substantially parallel to the guide, as indicated by arrow 64. As shown in FIG. 4, the first roller 44 is at its maximum distance from the second, or drive roller 14, thus providing a maximum effective thermal transfer nip width $W_{nmax}$ for this arrangement when the third or idler roller is at a low position. However, viewing FIG. 5, when the idler roller 60 is raised in the direction of arrow 66 away from the guide, this draws the top portion 62 of the belt 48 upward, and consequently draws the first roller 44 closer to the drive roller 14. This reduces the length of the tangent portion 50 of the belt, which is proximate to the guide 42, and thus reduces the effective thermal nip width. Shown in FIG. 5 are several possible positions of the first roller and idler, providing various effective thermal nip widths from a large width $W_{n2}$ to a smaller width, $W_{n1}$. It will be apparent that positions providing widths between $W_{n2}$ and $W_{n1}$ are possible, and that the system may be designed to provide desired maximum and minimum values for $W_n$.

The first idler 44 can be spring-biased away from the second, or drive roller 14, so as to maintain tension on the belt 48 while the third, idler roller 60 is mechanically moveable to provide an upward pull against this biasing force in order to effect the change in effective thermal nip width. Alternatively, the idler roller may be upwardly spring biased, while the first roller is configured to be moveable horizontally there against, to thereby change the effective thermal nip width. It will be apparent that a default position of the system may be that of a minimum effective thermal nip width, with the first roller disposed as close as possible to the second, or drive roller. Then, when additional fusing thermal energy is required, the idler roller is caused to move downward while first roller moves away from the drive roller, thus increasing the effective thermal nip width.

The movement path of the third, or idler roller 60, indicated by arrow 66, is substantially upward, but need not be vertical and can be curved or straight, for example. The upwardly angled configuration shown in FIG. 5 generally maintains the idler roller in a position substantially midway between the drive roller 14 and the first roller 44, as measured along the guide 42.

In another embodiment, shown in FIG. 6, a third, or idler roller 68 is disposed against an outside surface 63 of the top portion 62 of the belt 48, and is moveable up and down in the direction of arrow 70 to draw the first roller 44 closer to the second, or drive roller 14, and thus shorten the effective thermal nip width. It will be apparent that because of the diameter of the drive roller (illustrated is relatively small compared to the distance between the drive roller and the first roller), and the idler roller being between the drive roller and the first roller, the illustrated configuration of FIG. 6 will not allow the first roller to be brought very close to the drive roller, and thus does not provide a very wide range of adjustability of effective thermal nip width. However, this configuration could be useful in some circumstances. By increasing the diameter of at least one of the first and second rollers 44, 14 respectively, the range of adjustivity can be increased provided the diameter of the third roller (idler) is kept small.

As shown in FIGS. 4, 5, and 6, the first roller 44 is relatively small in diameter compared to the second, or drive roller 14. This allows the center of the first roller to draw nearer to the drive roller than would be possible if the first idler were larger in diameter. Consequently, this allows a greater range of adjustability of the effective thermal nip width for a given maximum nip width. The third, or idler roller 60 (68 in FIG. 6) is also relatively small for similar reasons. In another embodiment the second, drive, roller 14, can also be of relatively smaller diameter, further increasing adjustability of the system. However, if the heater (not shown) is contained in the second roller 14, this can effectively limit how small the roller can be made. Likewise, if the heater is contained in the first or third rollers this can also limit how small there diameter can be made. Providing for sufficient contact time between the belt 48 and the roller, and providing for the heater (usually a heat lamp) within the roller both tend to enlarge the diameter or at least limit how small it can be made. In another embodiment the heater (not shown) can be a discrete element disposed adjacent the belt 48 other than within a roller. For example a heat lamp directed at the belt at a location between rollers, either inside or outside the belt, or outside the belt adjacent a roller, can be used to direct thermal energy into the continuous belt. Resistive heating element(s) can be used, and can be located adjacent the belt; or can be incorporated in the belt, for example with contacts on one or more rollers or slidingly abutting the belt to bring in power. Because the belt is nickel, it can also be inductively heated.

It is to be understood that the above-described arrangements are only illustrative of applications for the principles of the present invention. Numerous modifications and alternative arrangements may be devised by those skilled in the art without departing from the spirit and scope of the present invention, and the appended claims are intended to cover such modifications and arrangements. Thus, while the present invention has been shown in the drawings and described above with particularity and detail in connection with what is presently deemed to be the most practical and preferred embodiment(s) of the invention, it will be apparent to those of ordinary skill in the art that these are examples, and numerous modifications, can be made without departing from the principles and concepts of the invention as set forth in the claims.

What is claimed is:

1. A system for varying an amount of thermal energy transmitted to print media advancing along a print oath in a printing device, comprising:

a heater configured to produce thermal energy;

a thermally conductive endless belt, rotatably carried by the printing device and configured to transmit thermal energy from the heater to the print media, at least a portion of said belt being disposed adjacent the print path along at least a portion thereof, a length of said belt portion adjacent the print path being adjustable so as to vary the amount of time print media advancing along the print path is adjacent said belt; and a first roller about which said belt turns, the first roller being movable parallel to the print path to vary the distance along the print path where said belt is adjacent the print path;

whereby the amount of thermal energy transmitted to print media traveling along the print path is adjustable.

2. A system for varying an amount of thermal energy transmitted to print media advancing along a print path in a printing device, comprising:

a heater configured to produce thermal energy;

a thermally conductive endless belt, rotatably carried by the printing device and configured to transmit thermal energy from the heater to the print media, at least a portion of said belt being disposed adjacent the print oath along at least a portion thereof, a length of said belt portion adjacent the print path being adjustable so as to vary the amount of time print media advancing along the print oath is adjacent said belt; and first, second, and third rollers, about which said belt turns, at least two of said the three rollers being movable with respect to a remaining roller of the three;

whereby the amount of thermal energy transmitted to print media traveling along the print path is adjustable.

3. A system for varying an amount of thermal energy transmitted to print media advancing along a print path in a printing device, comprising:

a heater configured to produce thermal energy;

a thermally conductive endless belt, rotatably carried by the printing device and configured to transmit thermal energy from the heater to the print media, at least a portion of said belt being disposed adjacent the print path along at least a portion thereof, a length of said belt portion adjacent the print nath being adjustable so as to vary the amount of time print media advancing along the print nath is adjacent said belt; and first, second, and third rollers about which said belt turns, at least one of the three rollers being movable parallel to the print path;

whereby the amount of thermal energy transmitted to print media traveling along the print path is adjustable.

4. A system for varying an amount of thermal energy transmitted to print media advancing along a print path in a printing device, comprising:

a heater configured to produce thermal energy; and a thermally conductive endless belt, rotatably carried by the printing device and configured to transmit thermal energy from the heater to the print media, at least a portion of said belt being disposed adjacent the print path along at least a portion thereof a portion of the print path to which said belt is adjacent being curved, a length of said belt portion adjacent the print oath being adjustable so as to vary the amount of time print media advancing along the print path is adjacent said belt;

whereby the amount of thermal energy transmitted to print media traveling along the print path is adjustable.

5. A system for varying an amount of thermal energy transmitted to print media advancing along a print path in a printing device, comprising:

a heater configured to produce thermal energy; and a thermally conductive endless belt, rotatably carried by the printing device and configured to transmit thermal energy from the heater to the print media, at least a portion of said belt being disposed adjacent the print oath along at least a portion thereof, a distance between the belt and the print media decreasing as the print media advances along the print path, so as to adjust a length of said belt portion adjacent the print path to vary the amount of time print media advancing along the print path is adjacent said belt;

whereby the amount of thermal energy transmitted to print media traveling along the print path is adjustable.

* * * * *

UNITED STATES PATENT AND TRADEMARK OFFICE

CERTIFICATE OF CORRECTION

PATENT NO. : 6,643,490 B2
APPLICATION NO. : 10/012468
DATED : November 4, 2003
INVENTOR(S) : Laurent A. Regimbal It is certified that error appears in the above-identified patent and that said Letters Patent is hereby corrected as shown below:

Column 6, Claim 1, line 30, delete “oath” and insert therefor --path--

Column 6, Claim 2, line 56, delete “oath” and insert therefor --path--

Column 6, Claim 2, line 59, delete “oath” and insert therefor --path--

Column 6, Claim 2, line 61, after “of” delete “said”

Column 7, Claim 3, line 7, delete “nath” and insert therefor --path--

Column 7, Claim 3, line 9, delete “nath” and insert therefor --path--

Column 7, Claim 4, line 24, after “thereof” insert --,--

Column 8, Claim 4, line 1, delete “oath” and insert therefor --path--

Column 8, Claim 5, line 16, delete “oath” and insert therefor --path--

Signed and Sealed this

Eleventh Day of March, 2008

JON W. DUDAS
*Director of the United States Patent and Trademark Office*